US008717264B2

(12) United States Patent
Lee

(10) Patent No.: US 8,717,264 B2
(45) Date of Patent: May 6, 2014

(54) DISPLAYING METHOD FOR ELECTROPHORETIC DISPLAY AND ELECTROPHORETIC DISPLAY USING THE SAME

(75) Inventor: Cheng-Hao Lee, Hsinchu (TW)

(73) Assignee: E Ink Holdings Inc., Hsinchu County (TW)

( * ) Notice: Subject to any disclaimer, the term of this patent is extended or adjusted under 35 U.S.C. 154(b) by 629 days.

(21) Appl. No.: 12/402,444

(22) Filed: Mar. 11, 2009

(65) Prior Publication Data

US 2010/0165445 A1 Jul. 1, 2010

(30) Foreign Application Priority Data

Dec. 29, 2008 (TW) ..... 97151298 A

(51) Int. Cl.
*G09G 5/00* (2006.01)
*G09G 3/36* (2006.01)
*G09G 3/34* (2006.01)

(52) U.S. Cl.
USPC ..... 345/87; 345/107; 345/589

(58) Field of Classification Search
USPC ..... 375/240.26; 345/87, 204, 107, 582, 55, 345/84, 105, 173, 690, 589; 349/86; 359/296, 265, 267, 273; 430/32
See application file for complete search history.

(56) References Cited

U.S. PATENT DOCUMENTS

| | | | | |
|---|---|---|---|---|
| 7,528,822 | B2 * | 5/2009 | Amundson et al. | 345/107 |
| 7,843,462 | B2 * | 11/2010 | Poon | 345/582 |
| 2003/0137521 | A1 * | 7/2003 | Zehner et al. | 345/589 |
| 2005/0024353 | A1 * | 2/2005 | Amundson et al. | 345/204 |
| 2006/0244718 | A1 * | 11/2006 | Hiddink et al. | 345/156 |
| 2007/0057905 | A1 * | 3/2007 | Johnson et al. | 345/107 |
| 2008/0068359 | A1 * | 3/2008 | Yoshida et al. | 345/204 |
| 2008/0079672 | A1 * | 4/2008 | Hsu | 345/87 |

FOREIGN PATENT DOCUMENTS

| | | | | |
|---|---|---|---|---|
| CN | 1938643 | A | 3/2007 | |
| JP | 2007-121704 | A * | 5/2007 | G09G 3/36 |
| TW | 200426746 | A | 12/2004 | |
| TW | 200736787 | A | 10/2007 | |
| WO | WO2008065605 | A2 | 6/2008 | |

OTHER PUBLICATIONS

Search Report—Office Action.
Taiwan Official Action issued on Feb. 25, 2013.

* cited by examiner

*Primary Examiner* — Quan-Zhen Wang
*Assistant Examiner* — Michael J Eurice
(74) *Attorney, Agent, or Firm* — Chun-Ming Shih

(57) ABSTRACT

A displaying method includes the following steps. First, display image frames and display a first color to clean images of a preceding image frame between the displaying of two image frames. Afterward, whenever a counting number of the image frames which have been displayed reaches a predetermined number, change to display one of the first color and a second color to clean images of the preceding image frame and then to display the other one of the first color and the second color to clean images of the preceding image frame between the displaying of two image frames for a while.

6 Claims, 10 Drawing Sheets

DISPLAYING METHOD FOR ELECTROPHORETIC DISPLAY AND ELECTROPHORETIC DISPLAY USING THE SAME

This application claims the priority benefit of Taiwan application serial no. 097151298, filed on Dec. 29, 2008

BACKGROUND

1. Technical Field

The present invention generally relates to the field of displaying technology and, more particularly, to a displaying method for an electrophoretic display and a corresponding electrophoretic display.

2. Description of the Related Art

Referring to FIG. 1, a schematic diagram of a portion of an electrophoretic display panel is shown. The electrophoretic display panel 100 includes a plurality of pixels 110, and the pixels are used for displaying image frames. An electrophoretic layer 120 of the electrophoretic display 100 includes a plurality of microcapsules 122, each of the microcapsules 122 being filled with electrophoretic fluid 124 therein. The electrophoretic fluid 124 filled in each of the microcapsules 122 includes dielectric solvent 124*a* and a plurality of charged pigment particles 124*b*.

In the charged pigment particles, the charged pigment particles 124*a* of white color are charged with positive charges, and the charged pigment particles 124*b* of black color are charged with negative charges. Thus, when the pixel electrodes 126 and 128 are exerted a positive voltage, the charged pigment particles 124*a* of white color will move toward the transparent electrode 130 while the charged pigment particles 124*b* of black color will move toward the pixel electrodes 126 and 128. On the contrary, when the pixel electrodes 126 and 128 are exerted a negative voltage, the charged pigment particles 124*b* of black color will move toward the transparent electrode 130 while the charged pigment particles 124*a* of white color will move toward the pixel electrodes 126 and 128. By using the control method as mentioned above, the electrophoretic display panel 100 could display needed image frame, namely displaying frames which have images.

Referring to FIG. 2, a schematic diagram of a conventional displaying method adapted for an electrophoretic display having an electrophoretic display panel is shown. In the displaying method as shown in FIG. 2, each of image frames is displayed sequentially. However, since the viscosity of aforementioned dielectric solvent limits the moving speed of the charged pigment particles, such that a current image frame may appear ghost images of a preceding image frame when the current image frame is displayed. For example, when the image frame 204 is displayed, the image frame 204 may appear ghost images of the image frame 202. Referring to FIG. 3, a schematic diagram illustrating the image frame 204 which appears a ghost image is shown. As shown in FIG. 3, the sun image 302 is the ghost image of the aforementioned image frame 202.

In order to solve the ghost image problem, a ghost image cleaning method is provided, as illustrated by FIG. 4. FIG. 4 illustrates a conventional ghost image cleaning method. Referring to the upper portion of the FIG. 4, the upper portion illustrates to display a white color frame and a black color frame to clean images of the preceding image frame between the displaying of two image frames. For example, when the image frame has been displayed, then the white color frame 404 and the black color frame 406 are displayed sequentially to clean images of the image frame 402. Afterward, the image frame 408 is displayed.

The disadvantage of the ghost image cleaning method can be explained by the whole frame brightness values as shown in the lower portion of the FIG. 4. As shown in FIG. 4, when an image frame is displayed, the whole frame brightness corresponding to the image frame is not the brightest and the darkest. However, since a white color frame displaying and a black color frame displaying are added in the duration of changing image frame, the durations of the white color frame displaying and the black color frame displaying must be very short so as to prevent the reading from being affected. Thus, in the duration of changing image frame, the whole frame brightness is increased to be the brightest and then immediately decreased to be the darkest in a short time, resulting in flicker of the vision to enable uncomfortable reading feeling.

BRIEF SUMMARY

The present invention relates to a displaying method for an electrophoretic display, which not only solves the ghost image problem of the electrophoretic display but also prevents flicker of the vision of user to enable uncomfortable reading feeling.

The present invention further relates to an electrophoretic display adopting aforementioned displaying method.

The present invention provides a displaying method for an electrophoretic display. The displaying method comprises the following steps. First, display image frames and display a first color to clean images of a preceding image frame between the displaying of two image frames. Afterward, whenever a counting number of the image frames which have been displayed reaches a predetermined number, change to display one of the first color and a second color to clean images of the preceding image frame and then to display the other one of the first color and the second color to clean images of the preceding image frame between the displaying of two image frames for a while.

The present invention provides an electrophoretic display, which includes an electrophoretic display panel, a data driving unit, a gate driving unit and a timing control unit. The data driving unit and the gate driving unit are coupled to the electrophoretic display panel. The timing control unit is used for controlling operations of the data driving unit and the gate driving unit so as to enable the electrophoretic display panel to display image frames. The timing control unit further enables the electrophoretic display panel to display a first color to clean images of a preceding image frame between the displaying of two image frames. Whenever a counting number of the image frames which have been displayed reaches a predetermined number, the timing control unit enables the electrophoretic display panel change to display one of the first color and a second color to clean images of the preceding image frame and then to display the other one of the first color and the second color to clean images of the preceding image frame between the displaying of two image frames for a while.

The present invention adopts two types of ghost image cleaning methods in image frame operation, and one type of the ghost image cleaning methods is a main ghost image cleaning method. In the main ghost image cleaning method, a first color displaying is used to clean images of a preceding image frame between the displaying of two image frames. Thus, the flicker of the frame could be reduced to further decrease the uncomfortable reading feeling. Whenever a counting number of the image frames which have been displayed reaches a predetermined number, change to adopt an auxiliary ghost image cleaning method for a while. In the auxiliary ghost image cleaning method, one of the first color displaying and a second color displaying is used to clean images of the preceding image frame and then the other one of the first color displaying and the second color displaying is used to clean images of the preceding image frame between the displaying of two image frames. Thus, the ghost images which can not be completely cleaned by the main ghost image cleaning method can be cleaned effectively.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
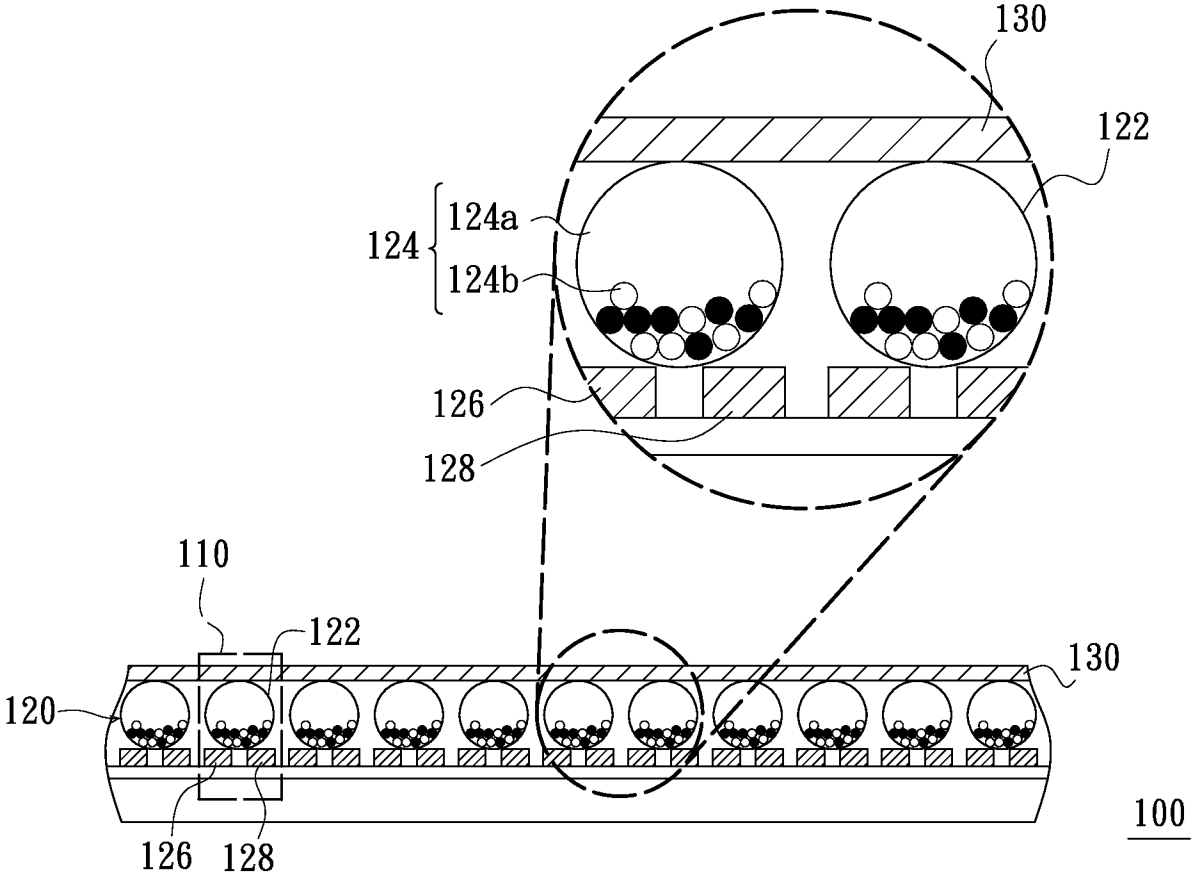
FIG. 1 (Prior Art)
FIG. 1 is a schematic diagram of a portion of an electrophoretic display panel.
Figure 2:
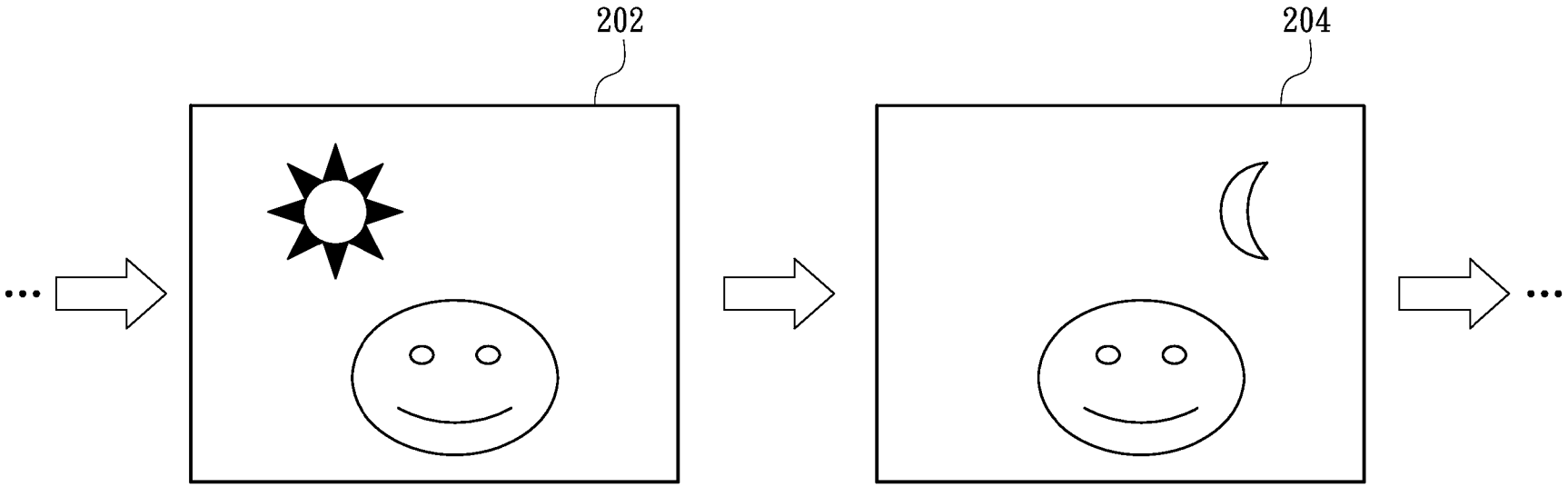
FIG. 2 (Prior Art)
FIG. 2 is a schematic diagram of a conventional displaying method adapted for an electrophoretic display having an electrophoretic display panel.
Figure 3:
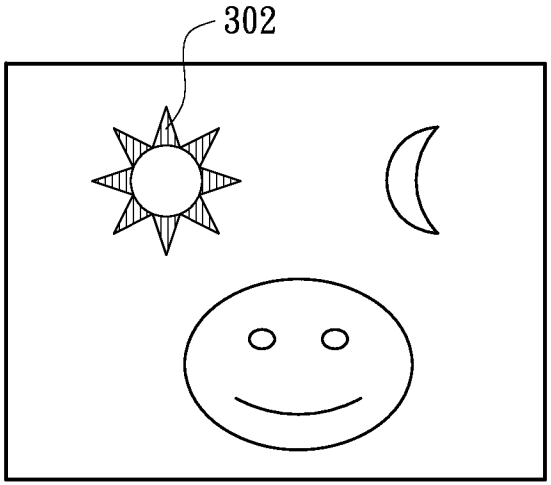
FIG. 3 (Prior Art)
FIG. 3 is a schematic diagram illustrating the image frame which appears the ghost image.
Figure 4:
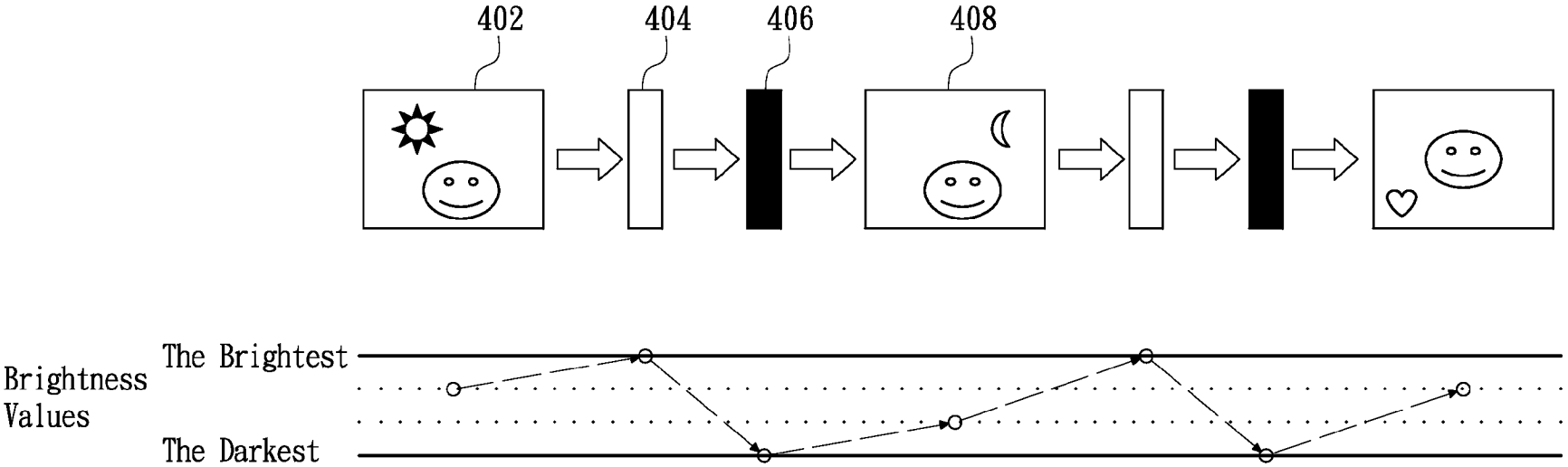
FIG. 4 (Prior Art)
FIG. 4 illustrates a conventional ghost image cleaning method.
Figure 5:
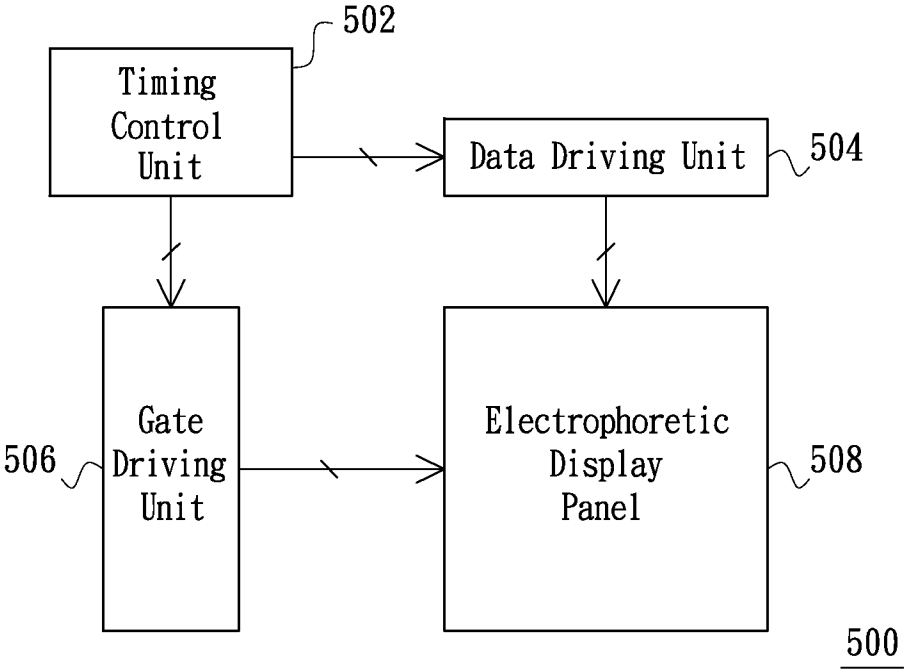
FIG. 5 is a schematic diagram of an electrophoretic display according to an embodiment of the present invention.

Referring to FIG. 5, a schematic diagram of an electrophoretic display according to an embodiment of the present invention is shown. As shown in FIG. 5, the electrophoretic display 500 includes a timing control unit 502, a data driving unit 504, a gate driving unit 506 and an electrophoretic display panel 508. The timing control unit 502 is coupled to the data driving unit 504 and the gate driving unit 506. The data driving unit 504 and the gate driving unit 506 are coupled to the electrophoretic display panel 508. In this embodiment, the electrophoretic display panel 508 is an electrophoretic display panel which has charged pigment particles of white color and black color as shown in FIG. 1. The charged pigment particles of white color are also charged with positive charges. The charged pigment particles of black color are also charged with negative charges. However, the electrophoretic display panel 508 of the present invention may also be an electrophoretic display panel which has charged pigment particles of other two colors as long as the charged pigment particles of aforementioned two colors are charged with two different polarities.

Figure 6:
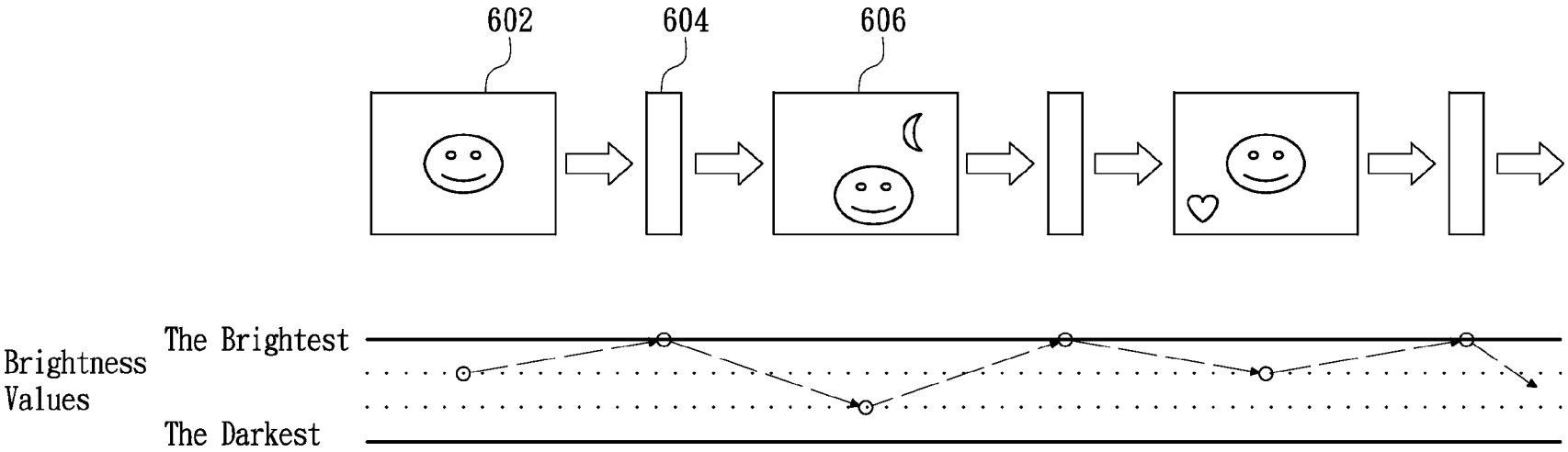
FIG. 6 is a schematic diagram of a ghost image cleaning method adopted in the present invention.

The timing control unit 502 is used for controlling operations of the data driving unit 504 and the gate driving unit 506 so as to enable the electrophoretic display panel 508 to display image frames. Further, the timing control unit 502 adopts two types of ghost image cleaning methods in image frame operation. One type of the ghost image cleaning methods is illustrated by FIG. 6. Referring to FIG. 6, a schematic diagram of a ghost image cleaning method adopted in the present invention is shown. As shown in the upper portion of the FIG. 6, the timing control unit 502 further enables the electrophoretic display panel 508 to display a white color frame to clean images of a preceding image frame between the displaying of two image frames. For example, after the image frame 602 has been displayed by the electrophoretic display panel 508, the timing control unit 502 enables the electrophoretic display panel 508 to display the white color frame 604 to clean the images of the image frame 602. After that, the timing control unit 502 enables the electrophoretic display panel 508 to display the image frame 606. Referring to the whole frame brightness values showing in the lower portion of the FIG. 6, in the duration of changing image frame, the whole frame brightness do not increased to be brightest and then immediately decreased to be darkest in a short time. Thus, the flicker of the frame could be reduced to further decrease the uncomfortable reading feeling.

Figure 7:
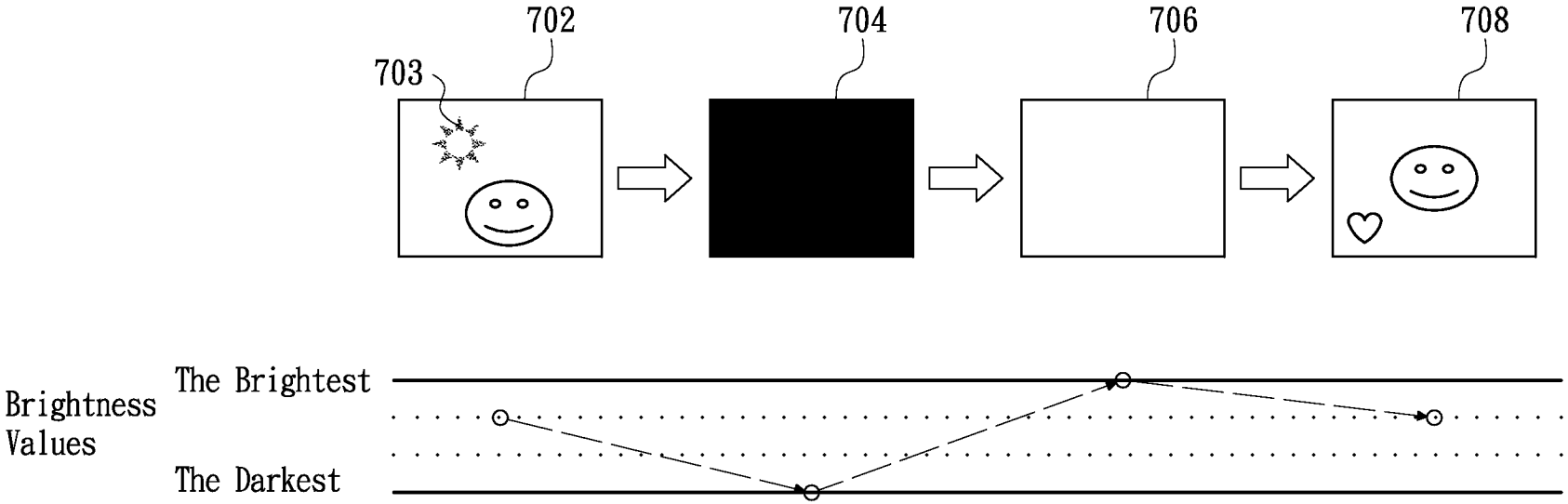
FIG. 7 is a schematic diagram of another ghost image cleaning method adopted in the present invention.

Further, whenever a counting number of the image frames which have been displayed reaches a predetermined number (e.g. 10 image frames), the timing control unit 602 changes to adopt an auxiliary ghost image cleaning method for a while, as shown in the FIG. 7. Referring to FIG. 7, a schematic diagram of another ghost image cleaning method adopted in the present invention is shown. As shown in the upper portion of the FIG. 6, the timing control unit 502 further enables the electrophoretic display panel 508 to display a black color frame and a white color frame to clean images of a preceding image frame between the displaying of two image frames. For example, after the image frame 702 has been displayed by the electrophoretic display panel 508, the timing control unit 502 enables the electrophoretic display panel 508 to sequentially display the black color frame 704 and the white color frame 706 to clean the images of the image frame 702. After that, the timing control unit 502 enables the electrophoretic display panel 508 to display the image frame 708. Thus, when the image frame 702 shows the ghost image 703 which can not be completely cleaned by the cleaning method illustrated in the FIG. 6, the ghost image 703 still can be effectively cleaned by the black color frame 704 and the white color frame 706 so that the image frame 708 do not shows any ghost image of the preceding image frame.

Even though, in the embodiment described by the FIG. 6, a white color frame is used for cleaning images of the preceding image frame between the displaying of two image frames. However, a black color frame can also be used for cleaning images of the preceding image frame between the displaying of two image frames. In addition, in the embodiment described by the FIG. 7, although a black color frame displaying is used first and then a white color frame displaying is used immediately so as to clean the images of the preceding image frame. However, it may also be used that a white color frame displaying is used first and then a black color frame displaying is used immediately so as to clean the images of the preceding image frame.

Moreover, by the teaching of aforementioned embodiment, one skilled person in the art should know that the timing control unit 502 may not only enable the electrophoretic display panel 508 to display the white color to clean all the images of the preceding image frame, but also may enable the electrophoretic display panel 508 to display the white color to clean part of the images of the preceding image frame. This will be described by the FIG. 8.

Figure 8:
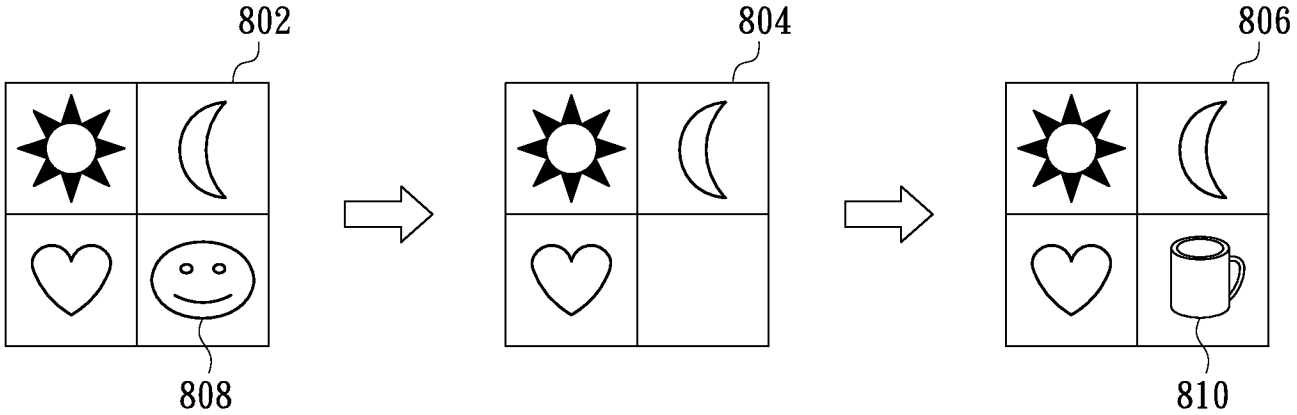
FIG. 8 is a schematic diagram of still another ghost image cleaning method adopted in the present invention.

Referring to FIG. 8, a schematic diagram of still another ghost image cleaning method adopted in the present invention is shown. As shown in FIG. 8, the timing control unit 502 could determine the difference between the image frames 802 and 806, so as to further determine what images shown in the image frame 802 should be cleaned by enabling the electrophoretic display panel 508 to display the white color. In this embodiment, the timing control unit 502 determines that the difference between the image frames 802 and 806 is that the different images are showed in the lower right-hand regions of the four regions of the two image frames. Therefore, in the duration between the displaying of the image frames 802 and 806, the timing control unit 502 enables a portion of the electrophoretic display panel 508 which corresponds to aforementioned lower right-hand regions to display the white color so as to clean the face image 808 of the image frame 802, as shown in image frame 804 of the FIG. 8. After that, the timing control unit 502 enables the electrophoretic display panel 508 to display the cup image 810 of the image frame 806.

Figure 9:
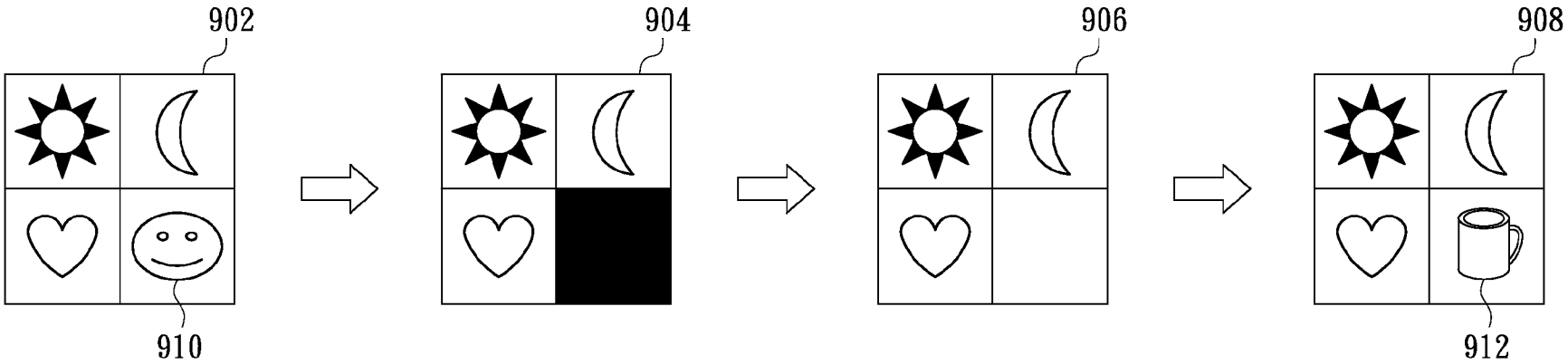
FIG. 9 is also a schematic diagram of still another ghost image cleaning method adopted in the present invention.

Likewise, by the teaching of aforementioned embodiment, one skilled person in the art should know that the timing control unit 502 may not only enable the electrophoretic display panel 508 to display the black color first and then immediately display the white color to clean all the images of the preceding image frame in the duration between displaying each two image frames, but also may enable the electrophoretic display panel 508 to display the black color first and then immediately display the white color to clean part of the images of the preceding image frame in the duration between displaying each two image frames, as illustrated by the FIG. 9. Referring to FIG. 9, a schematic diagram of still another ghost image cleaning method adopted in the present invention is also shown. Since the operating manner illustrated by the FIG. 9 could be speculated by the operating manner illustrated by the FIG. 8, no more description is further described.

Figure 10:
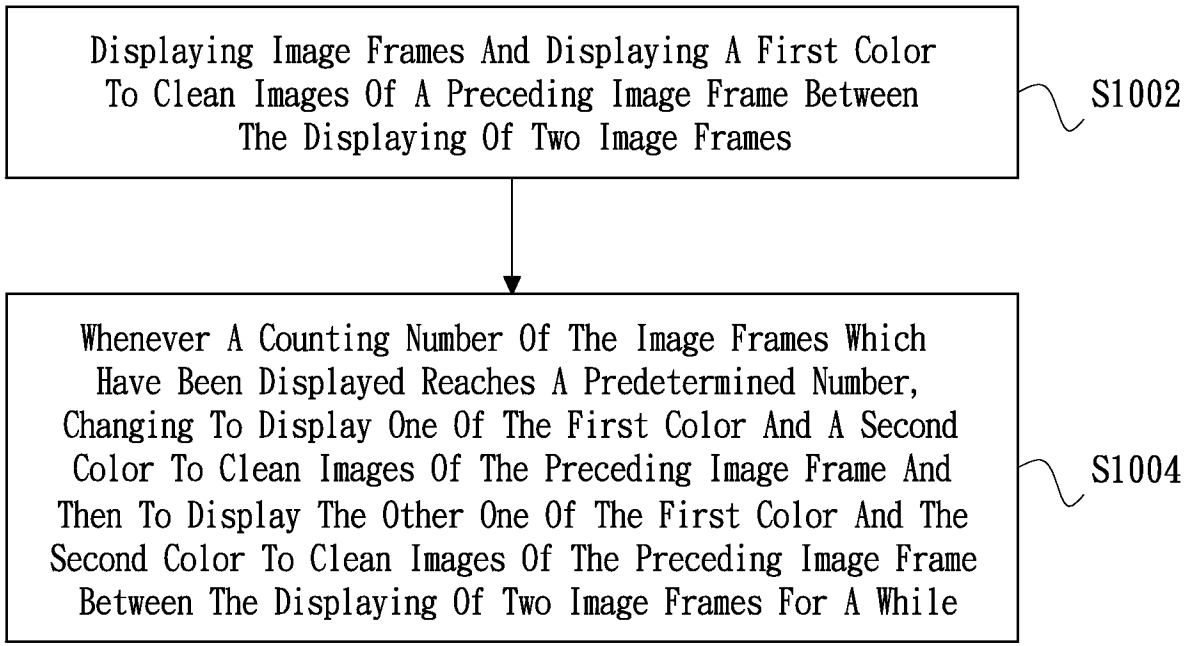
FIG. 10 is a flow chart of a displaying method suitable for an electrophoretic display according to the present invention.

To sum up the teaching of aforementioned embodiments, a basic operation concept could be inducted, as shown by the FIG. 10. Referring to FIG. 10, a flow chart of a displaying method according to the present invention is shown. The displaying method is suitable for an electrophoretic display. As shown in FIG. 10, the displaying method comprises the following steps. First, display image frames and display a first color to clean images of a preceding image frame between the displaying of two image frames (as shown in step S1002). Afterward, whenever a counting number of the image frames which have been displayed reaches a predetermined number, change to display one of the first color and a second color to clean images of the preceding image frame and then to display the other one of the first color and the second color to clean images of the preceding image frame between the displaying of two image frames for a while (as shown in step S1004).

In summary, the present invention adopts two types of ghost image cleaning methods in image frame operation, and one type of the ghost image cleaning methods is a main ghost image cleaning method. In the main ghost image cleaning method, a first color displaying is used to clean images of a preceding image frame between the displaying of two image frames. Thus, the flicker of the frame could be reduced to further decrease the uncomfortable reading feeling. Whenever a counting number of the image frames which have been displayed reaches a predetermined number, change to adopt an auxiliary ghost image cleaning method for a while. In the auxiliary ghost image cleaning method, one of the first color displaying and a second color displaying is used to clean images of the preceding image frame and then the other one of the first color displaying and the second color displaying is used to clean images of the preceding image frame between the displaying of two image frames. Thus, the ghost images which can not be completely cleaned by the main ghost image cleaning method can be cleaned effectively.

What is claimed is:

1. A displaying method for an electrophoretic display, the displaying method comprising:

providing image frames and determining a difference between two consecutive image frames, wherein the determined different region of a preceding image frame of the two consecutive image frames displays a different image from a following image frame of the two consecutive image frames, and a remaining region of the preceding image frame displays the same image as the following image frame; and performing a first ghost image cleaning procedure by providing a first insertion frame between any two consecutive image frames to clean the image displayed by the determined different region of the preceding image frame, wherein the first insertion frame consists of two regions, one of the two regions corresponds to the different region of the preceding image frame, and displays one of a black color image and a white color image to clean the image displayed by the different region of the preceding image frame; and the other one of the two regions corresponds to the remaining region of the preceding image frame, and displays the same image as the remaining region of the preceding image frame.

2. The displaying method as claimed in claim 1, wherein whenever a counting number of the image frames which have been displayed reaches a predetermined number, changing to perform a second ghost image cleaning procedure by displaying one of the first insertion frame and a second insertion frame and then displaying the other one of the first insertion frame and the second insertion frame to clean the image displayed by the determined different region of the preceding image frame of the two consecutive image frames right after the counting number reaches the predetermined number, wherein the second insertion frame consists of two regions, one of the two regions corresponds to the determined different region of the preceding image frame, and displays the other one of the black color image and the white color image; and the other one of the two regions corresponds to the remaining region of the preceding image frame, and displays the same image as the remaining region of the preceding image frame.

3. The displaying method as claimed in claim 2, wherein the predetermined number is 10.

4. An electrophoretic display, comprising:

an electrophoretic display panel;

a data driving unit, coupled to the electrophoretic display panel;

a gate driving unit, coupled to the electrophoretic display panel; and a timing control unit, used for controlling operations of the data driving unit and the gate driving unit so as to enable the electrophoretic display panel to display image frames, wherein the timing control unit further enables the electrophoretic display panel to perform a first ghost image cleaning procedure by providing a first insertion frame between any two consecutive image frames after determining a difference between the two consecutive image frames to clean an image displayed by the determined different region of a preceding image frame of the two consecutive image frames, wherein the determined different region of the preceding image frame displays a different image from a following image frame of the two consecutive image frames, and a remaining region of the preceding image frame displays the same image as the following image frame, the first insertion frame consists of two regions, one of the two regions corresponds to the determined different region of the preceding image frame, and displays one of a black color image and a white color image to clean the image displayed by the different region of the preceding image frame; and the other one of the two regions corresponds to the remaining region of the preceding image frame, and displays the same image as the remaining region of the preceding image frame.

5. The electrophoretic display as claimed in claim 4, wherein whenever a counting number of the image frames which have been displayed reaches a predetermined number, the timing control unit enables the electrophoretic display panel change to perform a second ghost image cleaning procedure by displaying one of the first insertion frame and a second insertion frame and then displaying the other one of the first insertion frame and the second insertion frame to clean the image displayed by the determined different region of the preceding image frame of the two consecutive image frames right after the counting number reaches the predetermined number, wherein the second insertion frame consists of two regions, one of the two regions corresponds to the determined different region of the preceding image frame, and displays the other one of the black color image and the white color image; and the other one of the two regions corresponds to the remaining region of the preceding image frame, and displays the same image as the remaining region of the preceding image frame.

6. The electrophoretic display as claimed in claim 5, wherein the predetermined number is 10.

* * * * *